US005388512A

United States Patent [19]

Tomita

[11] Patent Number: 5,388,512

[45] Date of Patent: Feb. 14, 1995

[54] DAMPENING SUPPRESSION APPARATUS FOR PRINTING PRESS

[75] Inventor: Minoru Tomita, Ibaragi, Japan

[73] Assignee: Komori Corporation, Tokyo, Japan

[21] Appl. No.: 128,894

[22] Filed: Sep. 29, 1993

[30] Foreign Application Priority Data

Oct. 9, 1992 [JP] Japan ..... 4-076477[U]

[51] Int. Cl.[6] ..... B41F 31/00; B41F 7/24

[52] U.S. Cl. ..... 101/148

[58] Field of Search ..... 101/147, 148, 366, 349, 101/350, 487, 351, 352

[56] References Cited

U.S. PATENT DOCUMENTS 2,843,040 7/1958 Childers .
4,075,875 2/1978 Heidan ..... 34/157
4,524,689 6/1985 Lemaster .
5,060,572 10/1991 Waizmann ..... 101/488
5,209,160 5/1993 Smith ..... 101/148

FOREIGN PATENT DOCUMENTS 0023629 2/1981 European Pat. Off. .

*Primary Examiner*—J. Reed Fisher
*Attorney, Agent, or Firm*—Blakely, Sokoloff, Taylor & Zafman

[57] ABSTRACT

A dampening suppression apparatus for a printing press includes a plurality of fans, air volume adjusting dials, and a driving controller. The fans are parallely arranged in an axial direction of an ink roller to oppose a circumferential surface thereof. The air volume adjusting dials respectively set the air volumes of the fans. The driving controller individually controls to drive each of the fans on the basis of outputs from the air volume adjusting dials.

8 Claims, 3 Drawing Sheets

DAMPENING SUPPRESSION APPARATUS FOR PRINTING PRESS

BACKGROUND OF THE INVENTION

The present invention relates to a dampening suppression apparatus for a printing press such as an offset press, which suppresses dampening water transferred to an inking arrangement.

In an offset press, ink and water are supplied to a plate mounted on the circumferential surface of a plate cylinder. At this time, dampening water supplied to the plate surface is transferred to a form roller, and then, to an upstream ink roller, i.e., so-called dampening occurs. The dampening water transferred to the ink roller forms a thin film on the ink on the ink roller. A small amount of dampening water transferred to the ink roller makes the ink concentration uneven to degrade the printing quality. In addition, the dampening water and the ink are emulsified to cause tinting or scumming. Especially, for printed matter having a large nonimage area, the dampening water is supplied to the nonimage area of the plate surface to which the ink is not supplied. For this reason, the dampening water is easily transferred to the ink roller, and the amount of the transferred water is increased so that the above problem becomes more serious.

Conventionally, air is sprayed to the surface of the ink roller to evaporate the film-like dampening water, thereby suppressing dampening. More specifically, a gas pipe is arranged near the ink roller to extend along its axis. Air holes are axially formed in the gas pipe, and shutters corresponding to the respective air holes are provided. The shutters to be opened/closed are selected in correspondence with the nonimage area of the plate surface, and the air is supplied from the air holes to the ink roller.

In the above conventional arrangement, the air supply position can be selected by opening/closing the shutters. However, the air volume cannot be adjusted in correspondence with the amount of transferred dampening water and its position on the ink roller, because the air volume from each air hole is constant. In addition, because of the structure using the gas pipe, air supply efficiency is degraded due to the piping resistance, and the structure does not cope with a compact printing press.

SUMMARY OF THE INVENTION

It is an object of the present invention to provide a dampening suppression apparatus for a printing press, which uniformly dries the ink roller in accordance with the amount of dampening water transferred to the ink roller.

It is another object of the present invention to provide a dampening suppression apparatus for a printing press, capable of adjusting the volume of the air supplied to the ink roller.

In order to achieve the above objects, there is provided a dampening suppression apparatus for a printing press, comprising a plurality of fans parallely arranged in an axial direction of an ink roller to oppose a circumferential surface thereof, first setting means for respectively setting the air volumes of the fans, and control means for individually controlling to drive each of the fans on the basis of outputs from the first setting means.

DESCRIPTION OF THE PREFERRED EMBODIMENT

Figure 1:
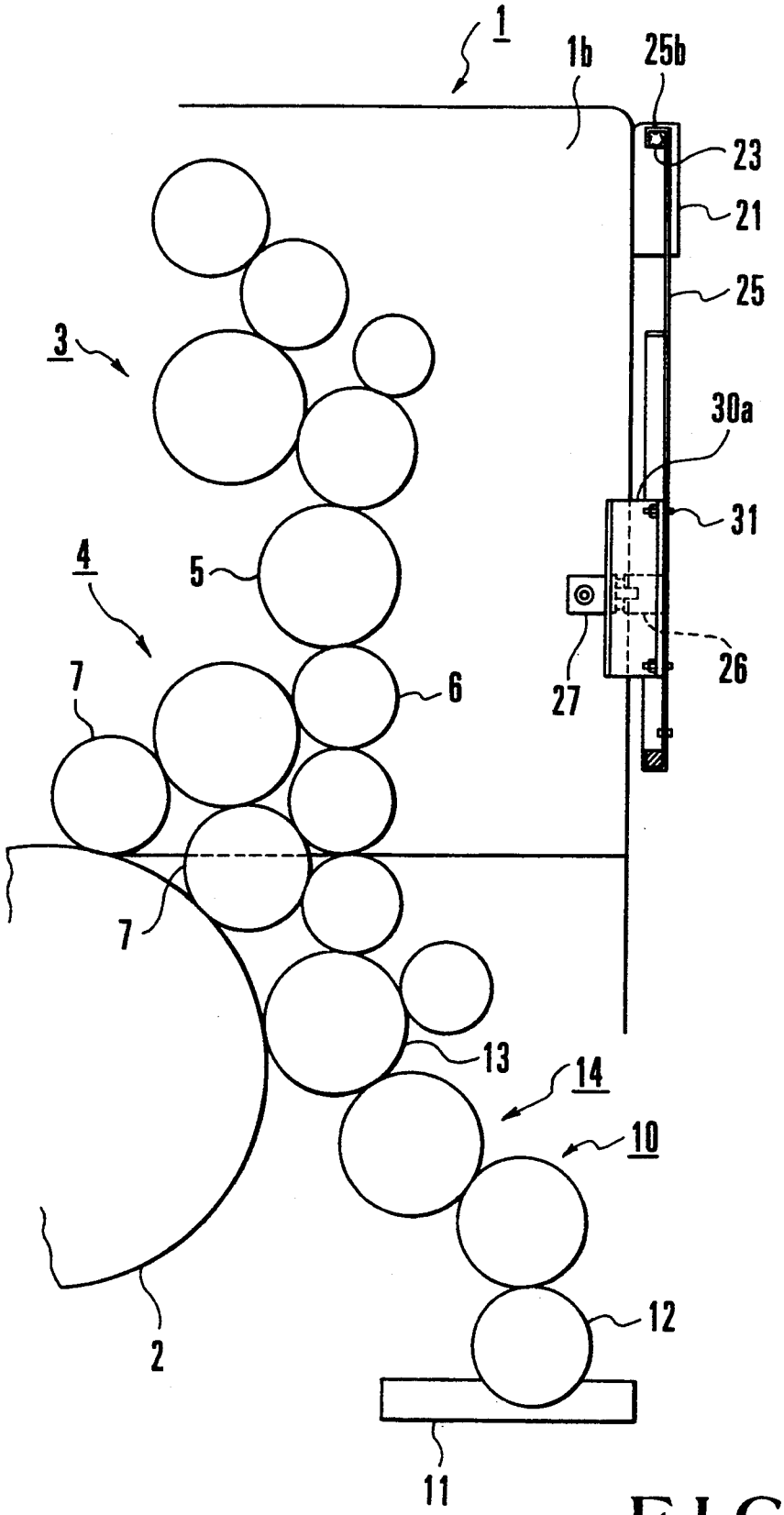
FIG. 1 is a side view showing a dampening suppression apparatus for a printing press according to an embodiment of the present invention.
Figure 2:
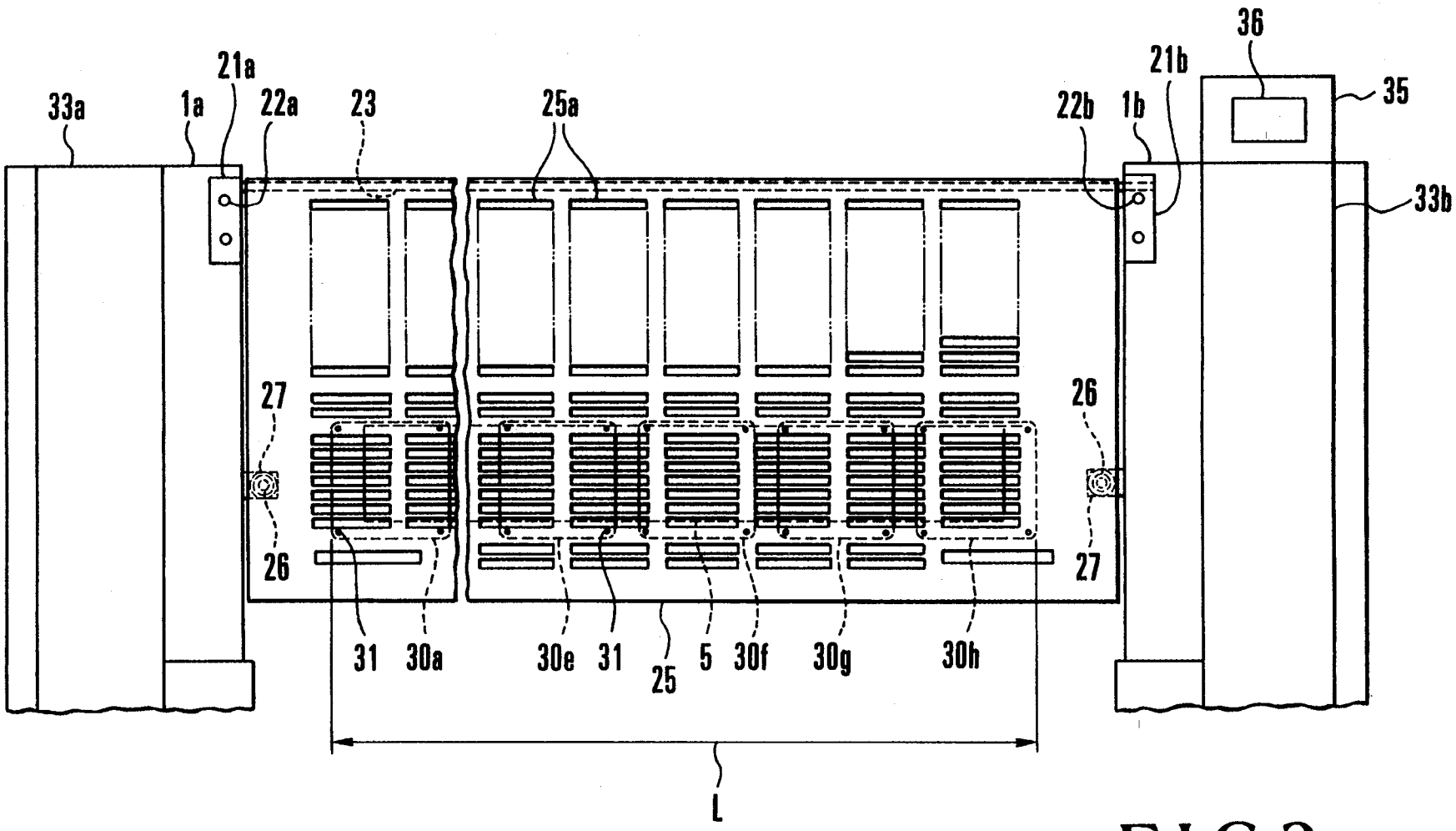
FIG. 2 is a front view showing the dampening suppression apparatus for a printing press according to the embodiment of the present invention.
Figure 3:
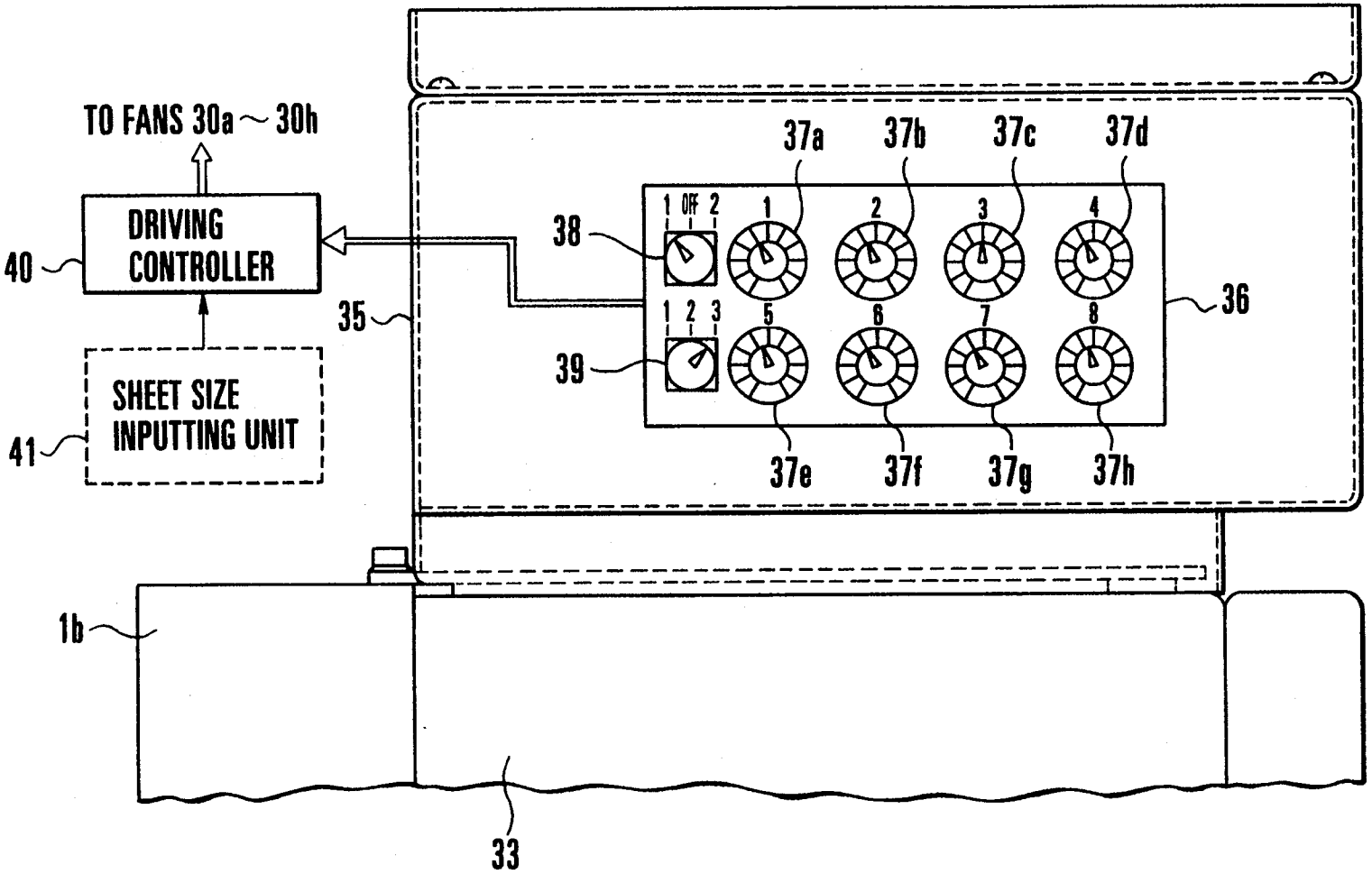
FIG. 3 is a front view showing a control unit of the dampening suppression apparatus for a printing press according to the present invention.

An embodiment of the present invention will be described below with reference to the accompanying drawings. FIGS. 1 and 2 show a dampening suppression apparatus for a printing press according to the present invention, and FIG. 3 shows a control unit thereof. Referring to FIGS. 1 to 3, reference numeral 1 denotes a printing unit. A plate cylinder 2 is axially supported by left and right frames 1*a* and 1*b* of the printing unit 1. A plate is mounted on the circumferential surface of the plate cylinder 2. The plate consists of an image area having an image pattern and a nonimage area having no image pattern. Covers 33*a* and 33b are provided to the outer surfaces of the frames 1*a* and 1*b*, respectively.

Reference numeral 3 denotes an inking arrangement. An ink roller group 4 comprising a plurality of ink rollers including an ink vibrating roller 5 and an ink distributing roller 6 is disposed to supply ink in an ink pot (not shown). The ink adhered to the ink vibrating roller 5 is uniformly distributed in all directions while being transferred between the rollers of the ink roller group 4 and is supplied to the image area of the plate surface by form rollers 7.

A water supply unit 10 comprises a water fountain 11 for storing dampening water (referred to as the water hereinafter). A water fountain roller 12 rotates while dipping a part thereof into the water in the water fountain 11. A dampening roller group 14 comprising a plurality of dampening rollers is disposed between the water fountain roller 12 and the plate cylinder 2. The amount of the water drawn by the water fountain roller 12 is adjusted while being transferred between the rollers of the dampening roller group 14 and is supplied to the nonimage area of the plate surface by a form dampening roller 13.

As shown in FIG. 2, a pair of shaft support members 21*a* and 21*b* are fixed to the front upper portions of the left and right frames 1*a* and 1*b* by bolts 22*a* and 22*b*, respectively. A shaft 23 is rotatably supported between the left and right frames 1*a* and 1*b* by the shaft support members 21*a* and 21*b*. Reference numeral 25 denotes a plate-like cover 25 having a plurality of elongated hole-like windows 25*a*. A bearing portion 25*b* having a U-shaped section is formed at the upper portion of the cover 25. The bearing portion 25*b* is supported on the square-sectional portion of the shaft 23. The cover 25 pivots together with the shaft 23 so as to open/close the front opening of the printing unit 1. A pair of fitting projections 26 are fixed on the lower surface of the cover 25 at its two lower side portions. Reception members 27, in which the fitting projections 26 are fitted, are fixed at the positions corresponding to the fitting projections 26. The fitting projections 26 are fitted in the reception members 27 to hold the closed state of the cover 25.

A plurality of compact fans 30*a* to 30*h* (30*b* to 30*d* are not shown) are parallely arranged on the lower surface of the cover 25 in the axial direction of the ink vibrating roller 5 to supply air to its circumferential surface. The fans 30*a* to 30*h* are mounted on the cover 25 by screws 31, respectively. A distance L from the left end of the fan 30*a* to the right end of the fan 30*h* is almost equal to the axial length of the ink vibrating roller 5 including the vibrating amount. When the fans 30*a* to 30*h* are operated, the air is supplied to the entire surface of the ink vibrating roller 5. In the operations of the fans 30*a* to 30*h*, the operation range of the fans can be selected, and the individual air volumes can be arbitrarily changed.

More specifically, as shown in FIG. 3, a switch box 35 having a switch panel 36 is provided above the cover 33 of the frame 1*b* of the printing unit 1. Air volume adjusting dials 37*a* to 37*h*, a first switch 38, and a second switch 39, all of which serve as an air volume setting means, are arranged on the switch panel 36.

The eight air volume adjusting dials 37*a* to 37*h* corresponding to the eight fans 30*a* to 30*h* continuously change the individual air volumes of the fans 30*a* to 30*h* from the maximum level to the minimum level. The first switch 38 selects the operation states of the fans 30*a* to 30*h*. If "1" is selected, the fans are driven together with the printing press in an interlocked manner only during the operation of the printing press. If "2" is selected, the fans are independently driven regardless of the operation of the printing press. If "OFF" is selected, the operations of all the fans 30*a* to 30*h* are stopped. The second switch 39 selects the operation range of the fans 30*a* to 30*h*. If "1" is selected, all the eight fans 30*a* to 30*h* are operated. If "2" is selected, the six fans 30*b* to 30*g* at the center are operated. If "3" is selected, the four fans 30*c* to 30*f* at the center are operated.

The air volume adjusting dials 37*a* to 37*h*, the first switch 38, and the second switch 39 are connected to a driving controller 40 for controlling to drive the fans 30*a* to 30*h*. The driving controller 40 individually controls the fans 30*a* to 30*h* in response to the outputs from the air volume adjusting means in the above-described manner. The air volumes of fans selected from the fans 30*a* to 30*h* by the second switch 39 to fall within the air supply range can be adjusted by the air volume adjusting dials 37*a* to 37*h*. Fans not selected to fall within the air supply range are not driven.

With this arrangement, an operation will be described below.

First, the second switch 39 is set in accordance with a sheet size. For a maximum sheet size, "1" is selected, thereby supplying the air to the ink vibrating roller 5 almost as a whole. For a minimum sheet size, "3" is selected, thereby supplying the air to only a part of the ink vibrating roller 5, which is equivalent to the sheet width. Next, in order to set whether the fans are to be operated together with the printing press in an interlocked manner, "1" or "2" of the first switch 38 is selected to operate the fans, thereby supplying the air to the ink vibrating roller 5. The air volume adjusting dials 37*a* to 37*h* are then operated to change the individual air volumes of the fans 30*a* to 30*h* in accordance with the amount of the transferred water which varies along the axis of the ink vibrating roller 5. In the case of the maximum sheet size, the switches 37*a* and 37*h*, which correspond to the fans 30*a* and 30*h* of the both end sides corresponding to the nonimage area of the plate surface, are pivoted up to the maximum scale value. The volumes of the air supplied to these portions are thus maximized, increasing the evaporation amount of the water of the nonimage area to which the water tends to be transferred. Hence, the operation states of the fans 30*a* to 30*h* can be selected in accordance with the sheet size, thereby uniformly evaporating the water transferred to the ink vibrating roller 5.

In the same manner, the operation states of the fans 30*a* to 30*h* can also be selected in accordance with the amount of water transferred to the ink vibrating roller, thereby uniformly evaporating the water transferred to the ink vibrating roller 5.

When roller nip adjustment or roller mounting/dismounting operation is to be performed, the cover 25 is opened together with the shaft 23 counterclockwise in FIG. 1 to open the front opening of the printing unit 1. At this time, the fans 30*a* to 30*h* are also opened together with the cover 25 to open the front opening of the printing unit 1. Therefore, the operation can be facilitated without any interference, and the operation time is shortened.

In this embodiment, the operation range of the fans 30*a* to 30*h* is selected by the second switch 39. However, the second switch 39 can be omitted. The minimum scale values of the individual air volume adjusting dials 37*a* to 37*h* are set at "0", i.e., OFF. By selectively setting the dials at "0" to stop the air supply, the fans 30*a* to 30*h* may be selectively operated.

Instead of the second switch 39, a sheet size inputting unit 41 indicated by a dotted line in FIG. 3 may be provided such that a driving controller 40 automatically selects the operation range of the fans 30*a* to 30*h* on the basis of the sheet size input to the sheet size inputting unit 41. The driving controller 40 may be a main controller for controlling to drive the entire printing press, e.g., a CPU using program control. In this case, a keyboard for inputting data to the CPU serves as the sheet size inputting unit.

Although the eight fans 30 are used in this embodiment, the number of fans is not limited to this. The number of fans can be selected in accordance with the ink roller length. In addition, the fans 30*a* to 30*h* oppose the ink vibrating roller 5 to evaporate the water transferred to the ink vibrating roller 5 in this embodiment. However, the positions of the fans 30*a* to 30*h* are not also limited to this. The fans may be arranged to oppose an ink distributing roller 6 or an arbitrary ink roller of the ink roller group 4.

Although the air volume adjusting dials 37 are provided to the switch panel 36, they may be provided at the positions corresponding to the individual fans 30*a* to 30*h*. Although the switch panel 36 is arranged together with the printing unit 1, it may be provided together with other switches to a central control panel such as an operation stand separated from the printing press. Various changes and modifications of the air volume adjusting dials 37 may be made. For example, the air volume may be adjusted by a push button and digitally displayed. In this embodiment, the cover 25 is opened together with the fans 30*a* to 30*h* mounted on the lower surface of the cover 25 to open the front opening of the printing unit 1. However, the arrangement of the fans is not limited to this. The fans 30*a* to 30*h* may be supported by a holder interposed between the left and right frames 1*a* and 1*b* through brackets. The fans 30*a* to 30*h* may be freely mounted/dismounted on the holder, or the holder may be freely mounted/dismounted on the brackets. With this arrangement, when roller nip adjustment or the roller mounting/dismounting operation is to be performed, the fans 30*a* to 30*h* are removed to open the front opening of the printing unit 1. The design can be variously changed.

As has been described above, according to the present invention, a plurality of fans are disposed to oppose the circumferential surface of the ink roller, and the air volume setting means for adjusting the air volumes of the individual fans is provided. The air volumes of the individual fans are adjusted in accordance with the amount of water transferred to the ink roller, thereby evaporating the water transferred to the ink roller uniformly along its axis. Therefore, the printing quality can be improved. At the same time, the operation range of the fans can be changed in accordance with the sheet size or nonimage area size, thereby effectively drying the ink roller.

What is claimed is:

1. A damping suppression apparatus for a printing press having an ink roller for supplying an ink, comprising:

a plurality of fans parallely arranged in an axial direction of said ink roller to oppose a circumferential surface thereof, said fans being movable to simultaneously come close to and separate away from the circumferential surface of said ink roller, air volumes of said fans being changeable;

first setting means for respectively setting the air volumes of said fans;

second setting means for setting an air supply range of said fans in the axial direction of said ink roller; and control means for stopping operation of said fans which fall outside the air supply range set by said second setting means and individually controlling the air volumes of the other of said fans in the air supply range set by said second setting means on the basis of outputs from said first setting means.

2. An apparatus according to claim 1, wherein said second setting means comprises a pattern selection switch means for selecting a pattern from a plurality of patterns indicating the air supply range which extends in the axial direction of said ink roller from a central portion to two ends thereof.

3. An apparatus according to claim 1, wherein said second setting means comprises a sheet size inputting unit means for inputting a printing sheet size, and said control means individually controls the operation/stop of each of said fans on the basis of the sheet size input in said sheet size inputting unit.

4. An apparatus according to claim 1, further comprising third setting means for setting whether said fans are to be driven together with said printing press in an interlocked manner or to be independently driven, and wherein said control means controls said fans using an output from said third setting means.

5. An apparatus according to claim 1, wherein said first setting means comprises a plurality of adjusting means, provided in correspondence with said fans, for continuously adjusting the air volumes.

6. An apparatus according to claim 5, wherein said adjusting means adjusts the air volumes of said fans in a range from a maximum level to zero.

7. An apparatus according to claim 1, further comprising a cover, axially pivotally supported at upper portions of left and right frames, for opening/closing a front opening of a printing unit, said printing unit including an inking device comprising a roller group including said ink roller, and wherein said fans are disposed on a lower surface of said cover at a position opposing said ink roller in a closed state of said front opening of said printing unit.

8. An apparatus according to claim 7, wherein said front opening of said printing unit is opened by an opening means when said fans pivot in accordance with a pivotal movement of said cover.

* * * * *